US011078724B2

(12) United States Patent
Chen et al.

(10) Patent No.: US 11,078,724 B2
(45) Date of Patent: Aug. 3, 2021

(54) WINDOW COVERING

(71) Applicant: NIEN MADE ENTERPRISE CO., LTD., Taichung (TW)

(72) Inventors: Lin Chen, Guangdong (CN); Keng-Hao Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 275 days.

(21) Appl. No.: 16/144,135

(22) Filed: Sep. 27, 2018

(65) Prior Publication Data

US 2020/0018115 A1 Jan. 16, 2020

(30) Foreign Application Priority Data

Jul. 13, 2018 (CN) ..... 201821115537.2
Jul. 26, 2018 (CN) ..... 201821193142.4

(51) Int. Cl.
*E06B 9/323* (2006.01)
*E06B 9/322* (2006.01)
*E06B 9/262* (2006.01)

(52) U.S. Cl.
CPC ..... *E06B 9/323* (2013.01); *E06B 9/322* (2013.01); *E06B 2009/2622* (2013.01)

(58) Field of Classification Search
CPC ... E06B 9/322; E06B 9/323; E06B 2009/2622
See application file for complete search history.

(56) References Cited

U.S. PATENT DOCUMENTS 2,804,924 A * 9/1957 Dennen ..... E06B 9/384 160/176.1 R
3,377,745 A * 4/1968 Einar ..... E06B 7/084 49/91.1
5,582,226 A * 12/1996 Voss ..... E06B 9/303 160/168.1 R
5,657,806 A * 8/1997 Hung ..... E06B 9/303 160/168.1 R
5,957,183 A * 9/1999 Prince ..... E06B 9/303 160/168.1 R
6,167,938 B1 * 1/2001 Chien ..... E06B 9/303 160/168.1 R
8,413,706 B2 * 4/2013 Kotin ..... E06B 7/086 160/236
8,844,603 B1 * 9/2014 Anti ..... E06B 9/307 160/176.1 R (Continued)

*Primary Examiner* — Beth A Stephan
(74) *Attorney, Agent, or Firm* — Muncy, Geissler, Olds & Lowe, P.C.

(57) ABSTRACT

A window covering includes a headrail and a covering material positioned under the headrail. The covering material includes a slat assembly. The headrail includes a traverse board and a pressure-dispersion structure, wherein the pressure-dispersion structure is positioned at the traverse board, and protrudes from a bottom surface of the traverse board. On a side of the pressure-dispersion structure facing the slat assembly, a pressure-dispersion area is formed corresponding to a topmost slat of the slat assembly which is closest to the headrail. When the covering material is raised and eventually contacts the headrail, the topmost slat can be controlled to contact at least part of the pressure-dispersion area, whereby to disperse a pressure applied to the slats.

14 Claims, 6 Drawing Sheets

(56) References Cited

U.S. PATENT DOCUMENTS

| | | | | |
|---|---|---|---|---|
| 8,991,469 | B2 * | 3/2015 | Defenbaugh | E06B 9/303 160/176.1 R |
| 2020/0248501 | A1 * | 8/2020 | Fries | E06B 9/322 |

* cited by examiner

WINDOW COVERING

BACKGROUND OF THE INVENTION

1. Technical Field

The present disclosure relates generally to a window covering, and more particularly to a venetian blind, which includes a headrail able to disperse pressure and therefore to prevent slats from being damaged or cracked by the headrail.

2. Description of Related Art

A conventional venetian blind 10 is shown in FIG. 1 and FIG. 2, which includes a headrail 12 and a covering material 14, wherein the covering material 14 is under the headrail 12, and a lifting cord 142 of the covering material 14 is connected to the headrail 12, so as to control the covering material 14 to be moved toward the headrail 12 (i.e., raised), or away from the headrail 12 (i.e., lowered). In addition, the covering material 14 further includes a ladder tape 144 and a plurality of slats 146. The ladder tape 144 includes two vertical cords and a plurality of traverse cords, wherein one end of each of the traverse cords is connected to one of the vertical cords, and another end thereof is connected to the other one of the vertical cords. Each of the slats 146 is positioned on one of the traverse cords correspondingly.

When the covering material 14 is moved away from the headrail 12 by an external force or by the weight of the covering material 14, and the slats 146 are driven by the ladder tape 144 to tilt to block light, there would be a gap left between the headrail 12 and the topmost slat 146*a* to allow light to pass through. To solve this issue, the headrail 12 of the conventional venetian blind 10 further includes a light-blocking bar 122 protruding from a bottom surface 1242 of a traverse plate 124 of the headrail 12. With such design, when the slats 146 are driven by the ladder tape 144 to tilt, the topmost slat 146*a* would abut against the light-blocking bar 122, so as to prevent light from passing through the gap between the bottom surface of the headrail 12 and the topmost slat 146*a*. In this way, the light blocking function of the venetian blind 10 could be improved.

However, when the covering material 14 is pushed by an external force to move toward the headrail 12, the topmost slat 146*a* could get damaged or broken by the light-blocking bar 122, for the topmost slat 146*a* of the covering material 14 would be tightly attached to the light-blocking bar 122 of the headrail 12. Therefore, how to prevent the slats of a venetian blind from being damaged or broken by the light-blocking bar is an important problem needed to be solved.

BRIEF SUMMARY OF THE INVENTION

In view of the above, the primary objective of the present invention is to provide a window covering, of which the slats could be prevented from being damaged or broken by the light-blocking bar. To achieve the above objective, the present invention provides a window covering including a headrail and a covering material, wherein the covering material is positioned under the headrail, and the covering material includes a slat assembly and a ladder tape. The ladder tape includes two vertical cords and a plurality of traverse cords, wherein one end of each of the traverse cords is connected to one of the vertical cords, and the other end thereof is connected to the other one of the vertical cords. One end of each of the vertical cords is connected to a tilting member positioned in the headrail. The slat assembly is positioned between the vertical cords, and each of the traverse cords respectively and correspondingly holds one of the slats of the slat assembly. The headrail includes a front board, a rear board, a traverse board, and a light-blocking bar, wherein the front board and the rear board are respectively connected to two opposite longitudinal sides of the traverse board; the light-blocking bar protrudes from a bottom surface of the traverse board, and extends along the longitudinal direction of the traverse board. When the covering material is lowered, the slats could be tilted by the tilting member through the ladder tape, whereby to block part of the topmost slat of the slat assembly by the light-blocking bar. The headrail further includes a pressure-dispersion structure positioned at the traverse board, protruding from a bottom surface of the traverse board. On one side of the pressure-dispersion structure facing the slat assembly, a pressure-dispersion area is formed corresponding to the topmost slat of the slat assembly. When the covering material is moved toward the headrail and eventually contacts the headrail, the slat operably contacts at least part of the pressure-dispersion area, whereby the pressure applied to the topmost slat could be dispersed.

In embodiments of the present invention, a central axis of the pressure-dispersion structure in the longitudinal direction and a central axis of the traverse board in the longitudinal direction are coplanar neither in a vertical direction nor a horizontal direction. Furthermore, in the horizontal direction, the central axis of the pressure-dispersion structure in the longitudinal direction is closer to the front board than that of the traverse board in the longitudinal direction.

In embodiments of the present invention, an area of the pressure-dispersion area is 20% to 90% of an area of the topmost slat.

In embodiments of the present invention, the pressure-dispersion area is a continuous plane, and is adapted to completely contact the topmost slat.

In embodiments of the present invention, the pressure-dispersion structure includes a first rib and a second rib, wherein the first rib and the second rib respectively extend in the longitudinal direction of the traverse board. A tip of the first rib and a tip of the second rib are coplanar, whereby to define the pressure-dispersion area.

In embodiments of the present invention, the tip of the first rib, the tip of the second rib, and a tip of the light-blocking bar are coplanar.

In embodiments of the present invention, the pressure-dispersion structure further includes a third rib positioned between the first rib and the second rib, and a tip of the third rib and the tips of the first rib and the second rib are coplanar.

In embodiments of the present invention, the third rib extends in the longitudinal direction of the traverse board.

In embodiments of the present invention, one end of the third rib is connected to the first rib, while another end thereof is connected to the second rib.

In embodiments of the present invention, the headrail further includes an opening going through the traverse board and the pressure-dispersion structure, and the end of each of the vertical cords of the ladder tape is connected to the tilting member in the headrail after passing through the opening.

In embodiments of the present invention, the covering material further includes a lifting cord, wherein one end of the covering material is adapted to drive the slat assembly to move, and another end thereof goes into the headrail through the opening.

In embodiments of the present invention, the light-blocking bar is adjacent to the pressure-dispersion structure.

In embodiments of the present invention, the light-blocking bar and the pressure-dispersion structure are formed integrally.

In embodiments of the present invention, the part of the surface of the topmost slat contacts a side surface of the light-blocking bar.

With the above design, when the covering material is raised and contacts the headrail, the slat operably contacts at least part of the pressure-dispersion area of the pressure-dispersion structure, whereby to disperse the pressure applied to the topmost slat.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
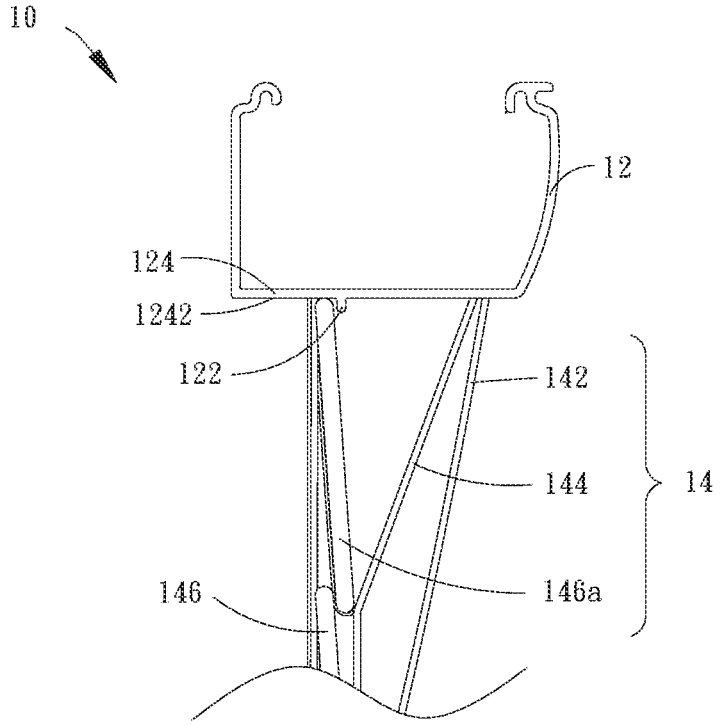
(Prior Art) Fig. 1
FIG. 1 is a side view of a conventional blind, wherein a covering material of the blind is extended, and slats thereof are tilted to block light.
Figure 2:
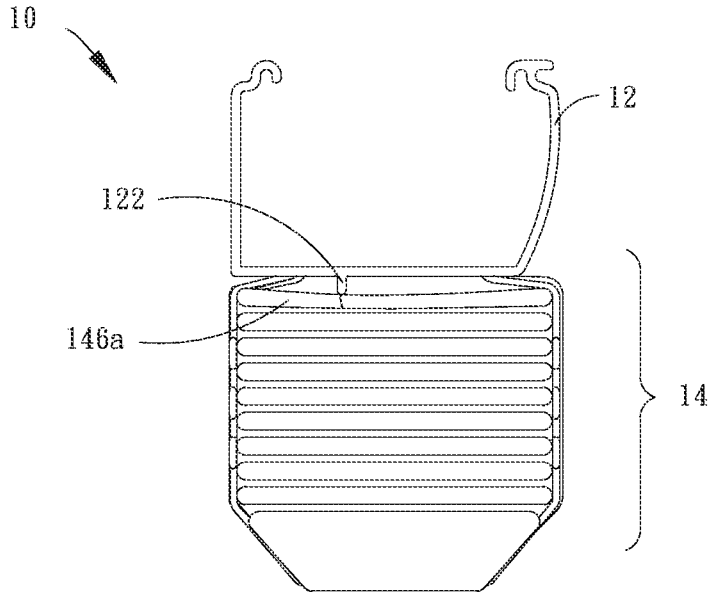
(Prior Art) Fig. 2
FIG. 2 is another side view of the conventional blind, wherein the covering material of the blind is pulled up.
Figure 3:
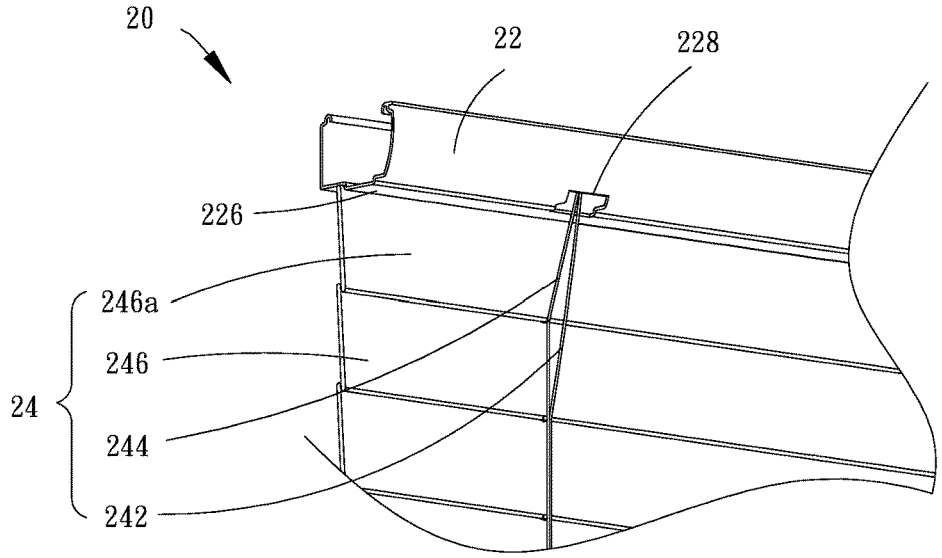
FIG. 3 is a perspective view of a blind implemented according to a first embodiment of the present invention.
Figure 4:
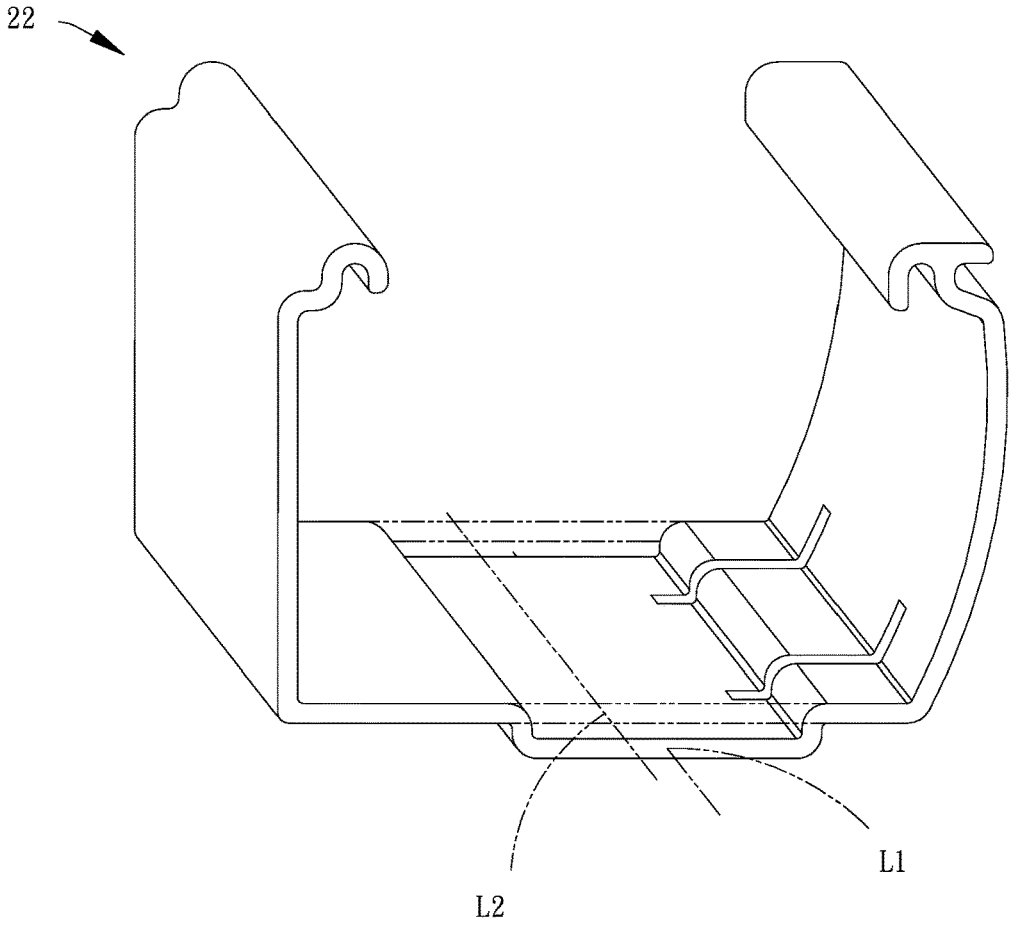
FIG. 4 is a perspective view of a headrail implemented according to the first embodiment of the present invention.
Figure 6:
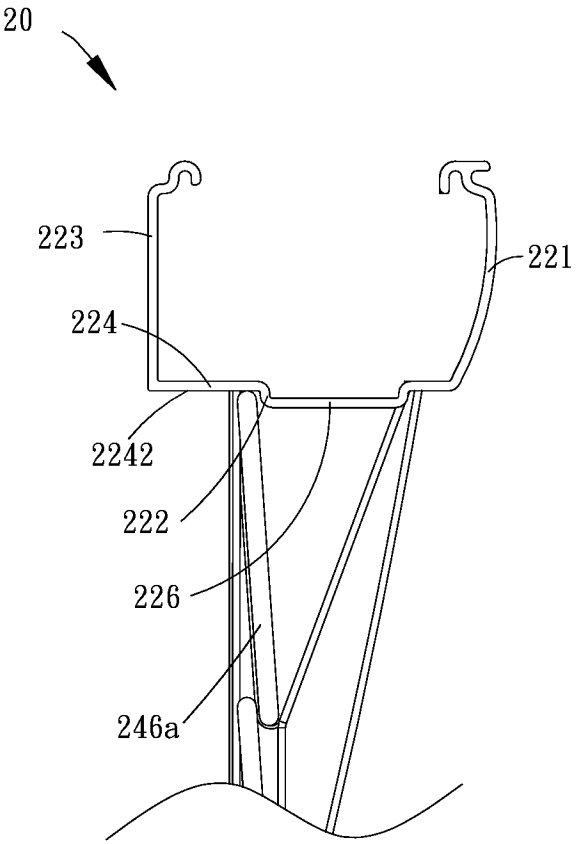
FIG. 6 is another side view of the blind implemented according to the first embodiment of the present invention, wherein the covering material of the blind is extended, and slats thereof are tilted to block light.
Figure 5:
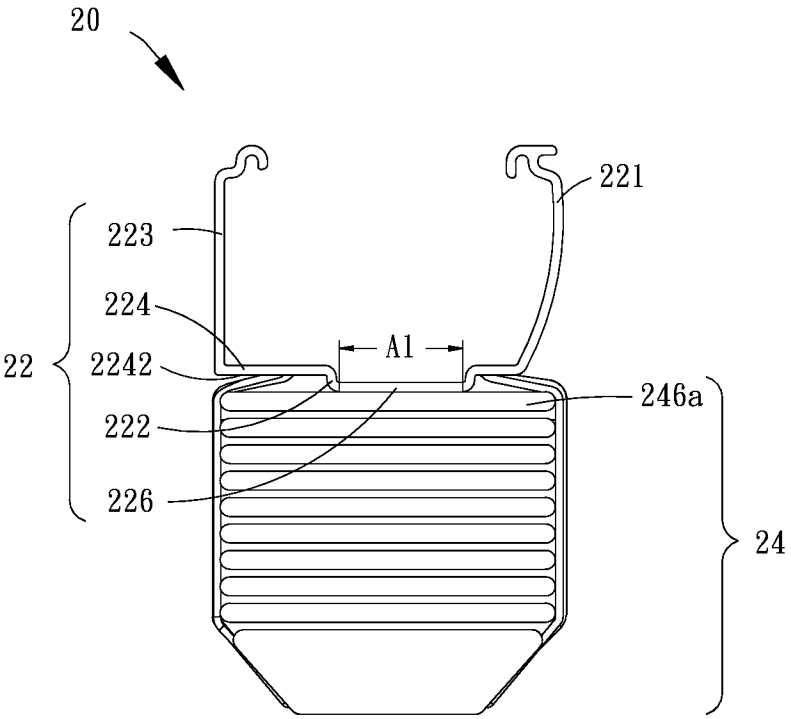
FIG. 5 is a side view of the blind implemented according to the first embodiment of the present invention, wherein a covering material of the blind is pulled up.
Figure 7:
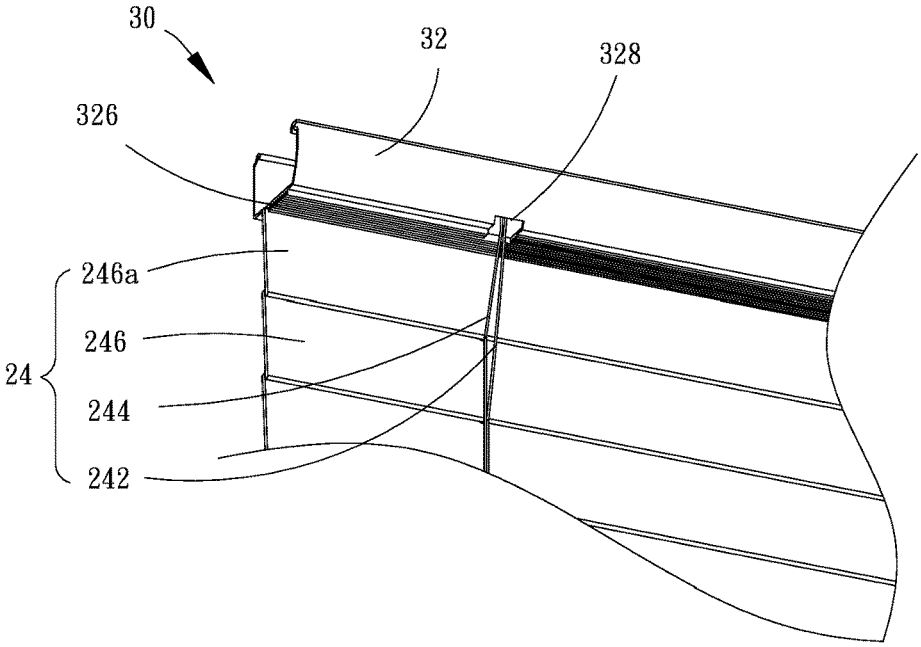
FIG. 7 is a perspective view of a blind implemented according to a second embodiment of the present invention.
Figure 8:
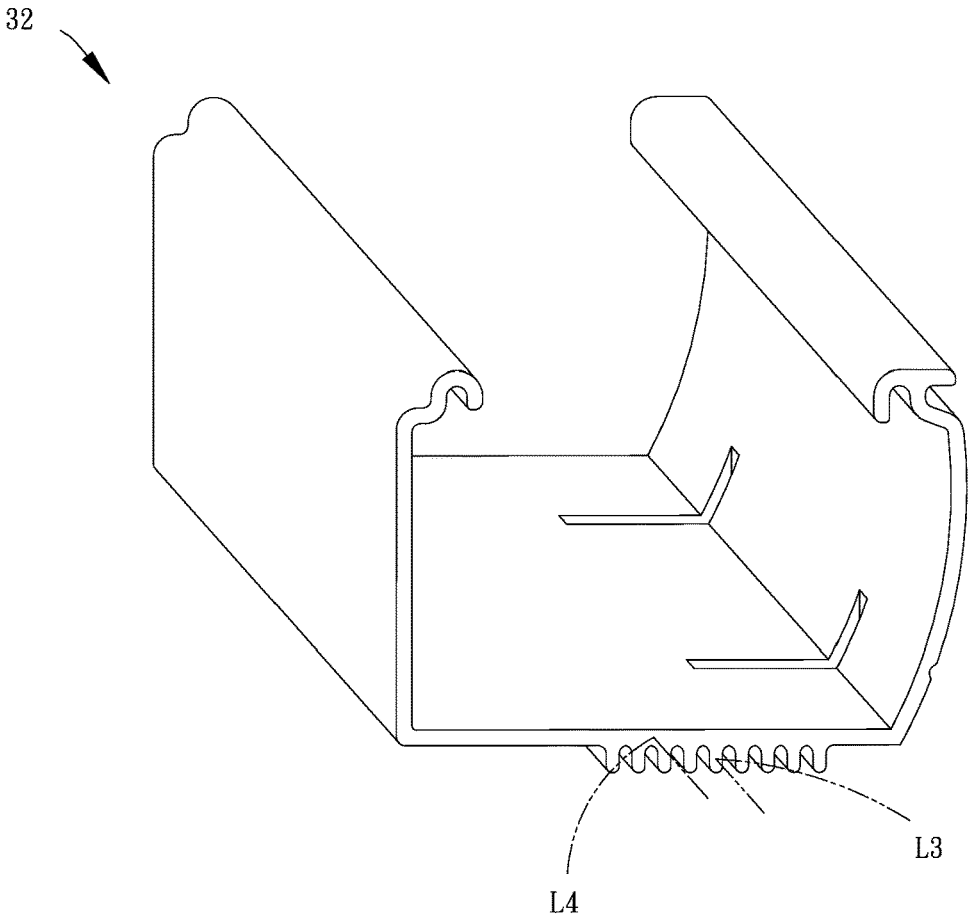
FIG. 8 is a perspective view of a headrail implemented according to the second embodiment of the present invention.
Figure 10:
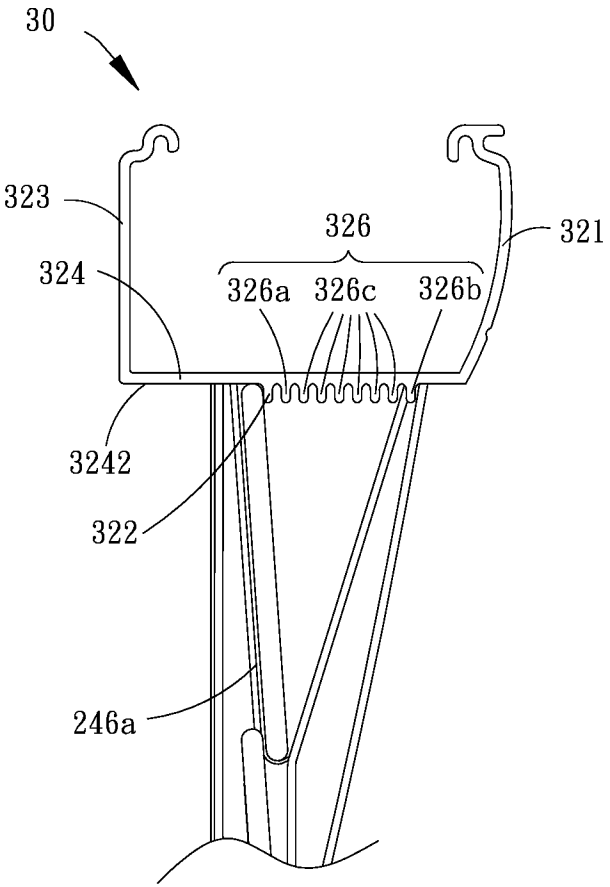
FIG. 10 is another side view of the blind implemented according to the second embodiment of the present invention, wherein the covering material of the blind is extended, and slats thereof are tilted to block light.
Figure 9:
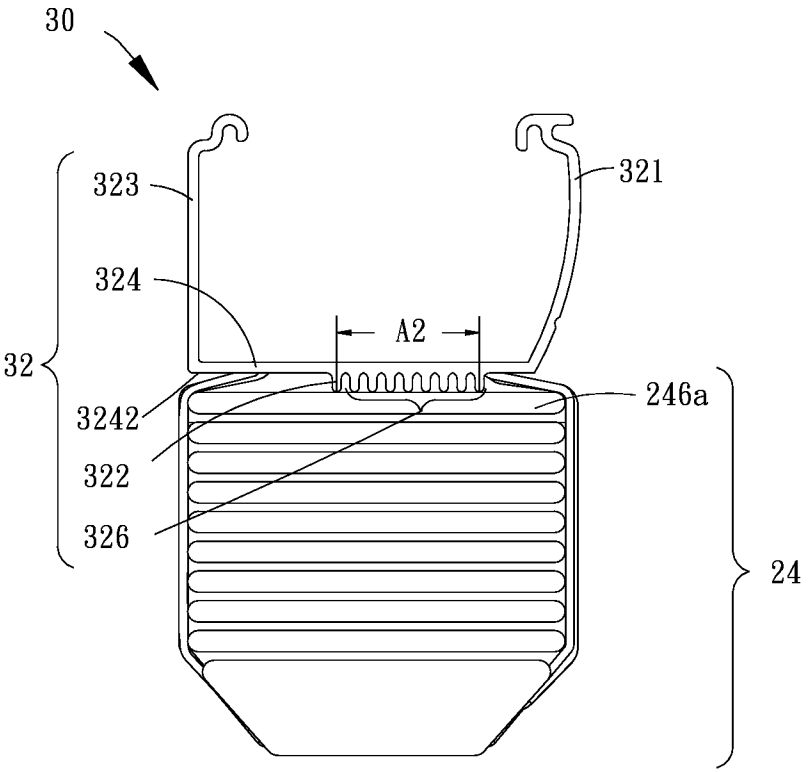
FIG. 9 is a side view of the blind implemented according to the second embodiment of the present invention, wherein a covering material of the blind is pulled up.

To easily understand the concept of the present invention, several embodiments are illustrated as the following with accompanying drawings. In each of embodiments of the present invention, the headrail includes side caps; however, the profiles of the side caps of each embodiment are omitted in the drawings for clear renderings. A window covering 20 implemented according to a first embodiment of the present invention is shown in FIG. 3 to FIG. 6, which includes a headrail 22 and a covering material 24, wherein the covering material 24 is located under the headrail 22. The covering material 24 includes a lifting cord 242, a ladder tape 244, and a plurality of slats 246, wherein the lifting cord 242 has one end passing through the headrail 12 to raise the covering material 24 toward the headrail 22 or to extend the covering material 24. The ladder tape 244 includes two vertical cords and a plurality of traverse cords, wherein each of the traverse cords has one end connected to one of the vertical cords while another end thereof is connected to the other one of the vertical cords, and thereby the ladder tape 244 is ladder-like. Each of the vertical cords had one end connected to a tilting member (not shown) in the headrail 22, and each of the slats 246 is correspondingly positioned on one of the traverse cords. The slats 246 include a topmost slat 246*a*, which is closest to the headrail 22.

In the present embodiment, the headrail 22 includes a front board 221, a light-blocking bar 222, a rear board 223, a traverse board 224, and a pressure-dispersion structure 226. The front board 221 and the rear board 223 are respectively connected to two opposite longitudinal sides of the traverse board 224. The light-blocking bar 222 protrudes from a bottom surface 2242 of the traverse board 224, and extends in the longitudinal direction of the traverse board 224. When the covering material 24 is lowered, the slats 246 could be driven to tilt by the tilting member through the ladder tape 244, and thereby a part of a surface of the topmost slat 246*a* could be covered by the light-blocking bar 222. The pressure-dispersion structure 226 is also positioned at the traverse board 224, and protrudes from the bottom surface 2242 of the traverse board 224. Furthermore, a pressure-dispersion area A1 is formed on one side of the pressure-dispersion structure 226 facing the slats 246, corresponding to the topmost slat 246*a*.

In the present embodiment, the pressure-dispersion structure 226 is a platform-like structure protruding toward the slats 246, and the pressure-dispersion area A1 is a continuous plane which could completely contact the slat 246*a*. When the covering material 24 is pulled up, the topmost slat 246*a* could be operated to contact the pressure-dispersion area A1, whereby the pressure applied to the topmost slat 246*a* could be dispersed. In accordance with the embodiment of the present invention, the area of the pressure-dispersion area A1 is 20% to 90% of the area of the topmost slat 246*a*. Besides, in the present embodiment, the light-blocking bar 222 and the pressure-dispersion structure 226 are formed integrally, and the pressure-dispersion structure 226 integrally protrudes from the traverse board 224, but these structures are not limitations of the present invention. In other embodiments, the pressure-dispersion structure 226 could be an independent component protruding under the traverse board 224 adjacent to the light-blocking bar 222.

It is worth mentioning that, a central axis L1 of the pressure-dispersion structure 226 in the longitudinal direction and a central axis L2 of the traverse board 224 in the longitudinal direction are coplanar neither in the vertical direction nor in the horizontal direction. Furthermore, in horizontal direction, the central axis L1 of the pressure-dispersion structure 226 is closer to the front board 221 than the central axis L2 of the traverse board 224 is. Whereby, when the slats 246 are tilted in a position where the front side of the slat is down and the rear side thereof is up, there would be a space sufficient to allow the topmost slat 246*a* to tilt, for the pressure-dispersion structure 222 is closer to the front board 221, so that the slats 246 could be tilted to a substantially vertical position, and therefore could be vertically arranged to be tightly closed by each other. In this way, a preferred light-blocking effect could be provided. Furthermore, in the present embodiment, a part of the surface of the topmost slat 246*a* could further contact the side surface of the light-blocking bar 222, whereby the slats 246 could be tilted to the substantially vertical position, so as to prevent light leakage.

In the current embodiment of the present invention, the lifting cord 242 of the covering material 24 is not limited to have to pass through holes on the slats, or have to pass through side edges of the slats 246 as shown in the drawings. To work with the related arrangements of the lifting cord 242, the ladder tape 244, and the slats 246 in the covering material 24, the headrail 22 in the current embodiment further includes several openings 228 going through the traverse board 224 and the pressure-dispersion structure 226, whereby one end of each of the vertical cords of the ladder tape 224 is connected to a tilting member in the headrail 22 after passing through one of the openings 228. Accordingly, one end of the lifting cord 242 could drive the slats 246 to move, and another end thereof could go into the headrail 22 through one of the openings 228.

A window covering 30 implemented according to a second embodiment of the present invention is shown in FIG. 7 to FIG. 10, which includes a headrail 32 and the covering material 24 positioned under the headrail 32. The window covering 30 in the second embodiment is similar to the window covering 20 in the first embodiment, except that the design of the headrail 32 is different from that of the headrail 22.

In the present embodiment, the headrail 32 includes a front board 321, a light-blocking bar 322, a rear board 324, and a pressure-dispersion structure 326. The front board 321 and the rear board 323 are respectively connected to two opposite longitudinal sides of the traverse board 324. The light-blocking bar 322 protrudes from a bottom surface 3242 of the traverse board 324, and extends in the longitudinal direction of the traverse board 324. When the covering material 24 is lowered, the slats 246 could be driven to tilt by the tilting member through the ladder tape 244, and thereby the part of the surface of the topmost slat 246*a* could be blocked by the light-blocking bar 322. The pressure-dispersion structure 326 is also positioned at the traverse board 324, and protrudes from the bottom surface 3242 of the traverse board 324. Furthermore, a pressure-dispersion area A2 is formed on one side of the pressure-dispersion structure 326 facing the slats 246, corresponding to the topmost slat 246*a* of the slats 246.

The pressure-dispersion structure 326 at least includes a first rib 326*a* and a second rib 326*b*, wherein the first rib 326*a* and the light-blocking bar 322 are co-constructed, whereby in the current embodiment, the light-blocking bar 322 and the first rib 326*a* are formed integrally. The first rib 326*a* and the second rib 326*b* respectively extend in a longitudinal direction of the traverse board 324, and a tip of the first rib 326*a* and a tip of the second rib 326*b* are coplanar to form a pressure-dispersion area A2. When the slats 246 are moved upward, the pressure applied to the topmost slat 246*a*, which is provided by the single light-blocking bar 322, could be dispersed by the pressure-dispersion area A2. According to the current embodiment of the present invention, the area of the pressure-dispersion area A2 is 20% to 90% of the area of the slat 246*a*. In the current embodiment, the light-blocking bar 322 is adjacent to the pressure-dispersion structure 326. In another embodiment, the light-blocking bar 322 and the first rib 326*a* of the pressure-dispersion structure 326 are formed integrally, and have the same tip to contact the slat 246*a*, which could be co-constructed with the tip of the second rib 326*b* to form the pressure-dispersion area A2. In the current embodiment, the pressure-dispersion structure 326 further includes at least one third rib 326*c* positioned between the first rib 326*a* and the second rib 326*b*, and the pressure-dispersion area A2 includes coplanar tips of the first rib 326*a*, the second rib 326*b*, and the third rib 326*c*. In the current embodiment, the third rib 326*c* extends in the longitudinal direction of the traverse board 324.

It is worth mentioning that, a central axis L3 of the pressure-dispersion structure 326 in the longitudinal direction and a central axis L4 of the traverse board 324 in the longitudinal direction are coplanar neither in the vertical direction nor in the horizontal direction. Furthermore, in the horizontal direction, the central axis L3 of the pressure-dispersion structure 326 is closer to the front board 321 than the central axis L4 of the traverse board 324. Whereby, when the slats 246 are tilted in a position where the front side of the slat is down and the rear side thereof is up, there would be a space sufficient to allow the topmost slat 246*a* to tilt, for the pressure-dispersion structure 322 is closer to the front board 321, so that the slats 246 could be tilted to a substantially vertical position, and could be vertically arranged to be tightly closed by each other, whereby a preferred light-blocking efficient could be provided.

In the current embodiment of the present invention, the lifting cord 242 of the covering material 24 is not limited to have to pass through holes on the slats, or have to pass through side edges of the slats 246 as shown in drawings. To work with the related arrangements of the lifting cord 242, the ladder tape 244, and the slats 246 in the covering material 24, the headrail 32 in the current embodiment further includes several openings 328 going through the traverse board 324 and the pressure-dispersion structure 326, whereby one end of each of the vertical cords of the ladder tape 224 is connected to a tilting member in the headrail 32 after passing through one of the openings 328. Accordingly, one end of the lifting cord 242 could drive the slats 246 to move, and another end thereof could go into the headrail 32 through one of the openings 328.

Figure 11:
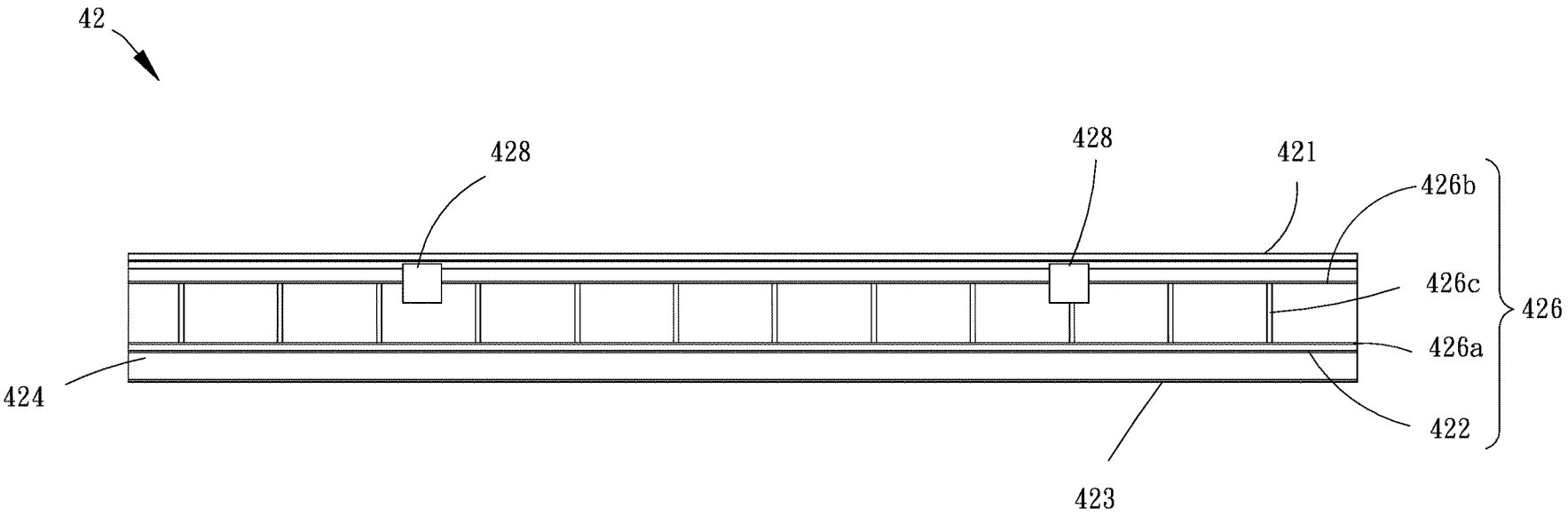
FIG. 11 is a bottom view of a headrail implemented according to a third embodiment of the present invention.

As shown in FIG. 11, the headrail 42 in the third embodiment is similar to the headrail 32 in the second embodiment; however, the difference between the headrail 42 in the third embodiment and the headrail 32 in the second embodiment is that, the third rib 426*c* in the headrail 42 is different from the third rib 326*c* of the headrail 32. In the current embodiment, the third rib 426*c* has one end connected to the first rib 426*a*, and another end connected to the second rib 426*b*; the tips of the first rib 426*a*, the second rib 426*b*, and the third rib 426*c* are coplanar. The headrail 42 further includes several openings 428 going through the traverse board 424 and the pressure-dispersion structure 426, whereby to allow a lifting cord and/or a ladder tape to go into the headrail 42 therethrough.

The headrail 42 includes a light-blocking bar 422 protruding from a bottom surface of the traverse board 424, and the light-blocking bar 422 extends in the longitudinal direction of the traverse board 424. In the current embodiment, the light-blocking bar 422 is adjacent to the pressure-dispersion structure 426.

When the covering material of the window covering is pulled up, the pressure-dispersion structure of the headrail in the embodiments of the present invention includes the pressure-dispersion area, of which the area is greater than the tip of the light-blocking bar. Besides, the pressure-dispersion area and the tip of the light-blocking bar could be coplanar, whereby to reduce the pressure applied to the topmost slat As a result, the topmost slat could be prevented from being damaged or broken while the covering material is being raised completely. On the other hand, the pressure-dispersion bar could be connected to the light-blocking bar to completely block light, whereby to prevent light from passing through the gap between the headrail and the topmost slat. Furthermore, there would be sufficient space for tilting the slats, so that the slats could be tilted to a substantially vertical position, and could be vertically arranged to be tightly closed by each other. Therefore, a preferred light-blocking effect could be provided.

It must be pointed out that the embodiments described above are only some preferred embodiments of the present invention. All equivalent structures which employ the concepts disclosed in this specification and the appended claims should fall within the scope of the present invention.

What is claimed is:

1. A window covering, comprising:

a headrail, which comprises a front board, a rear board, a traverse board, a light-blocking bar, and a pressure-dispersion structure, wherein the front board and the rear board are respectively connected to two opposite longitudinal sides of the traverse board; the light-blocking bar protrudes from a bottom surface of the traverse board, and extends in a longitudinal direction of the traverse board; the pressure-dispersion structure is positioned at the traverse board, and protrudes from the bottom surface of the traverse board; and a covering material, which is positioned under the headrail, and comprises a slat assembly and a ladder tape, wherein the ladder tape comprises two vertical cords and a plurality of traverse cords; one end of each of the traverse cords is connected to one of the vertical cords, and another end thereof is connected to the other one of the vertical cords; one end of each of the vertical cords is connected to a tilting member in the headrail; the slat assembly is positioned between the vertical cords, and has a plurality of slats, wherein each of the traverse cords respectively correspondingly holds one of the slats of the slat assembly; the plurality of slats comprises a topmost slat which is closest to the headrail;

wherein a pressure-dispersion area is formed on a side of the pressure-dispersion structure facing the slat assembly, corresponding to the topmost slat;

when the covering material is lowered, the slats of the slat assembly are adapted to be tilted by the tilting member through the ladder tape; when the slats are tilted to a closed position, the light-blocking bar covers a part of a surface of the topmost slat; said part of the surface of the topmost slat covered by the light-blocking bar is defined as an abutting area;

when the covering material is raised and contacts the headrail, the topmost slat operably contacts the pressure-dispersion area in a manner that the topmost slat and the pressure-dispersion area have no gap left therebetween;

wherein the pressure-dispersion area and the topmost slat are both flat;

wherein the pressure-dispersion area is larger than the abutting area of the topmost slat to disperse a pressure applied to the topmost slat.

2. The window covering of claim 1, wherein a central axis of the pressure-dispersion structure in the longitudinal direction and a central axis of the traverse board in the longitudinal direction are coplanar neither in a vertical direction nor in a horizontal direction; in the horizontal direction, the central axis of the pressure-dispersion structure in the longitudinal direction is closer to the front board than the central axis of the traverse board in the longitudinal direction.

3. The window covering of claim 1, wherein an area of the pressure-dispersion area is 20% to 90% of an area of the topmost slat.

4. The window covering of claim 1, wherein the pressure-dispersion area is a continuous plane, and is adapted to completely contact the topmost slat.

5. The window covering of claim 1, wherein the pressure-dispersion structure comprises a first rib and a second rib, wherein the first rib and the second rib respectively extend in the longitudinal direction of the traverse board; a tip of the first rib and a tip of the second rib are coplanar, whereby to define the pressure-dispersion area.

6. The window covering of claim 5, wherein the tip of the first rib, the tip of the second rib, and a tip of the light-blocking bar are coplanar.

7. The window covering of claim 5, wherein the pressure-dispersion structure further comprises a third rib positioned between the first rib and the second rib, and a tip of the third rib and the tips of the first rib and the second rib are coplanar.

8. The window covering of claim 7, wherein the third rib extends in the longitudinal direction of the traverse board.

9. The window covering of claim 7, wherein one end of the third rib is connected to the first rib, while another end thereof is connected to the second rib.

10. The window covering of claim 1, wherein the headrail further comprises an opening going through the traverse board and the pressure-dispersion structure, and the end of each of the vertical cords of the ladder tape is connected to the tilting member in the headrail after passing through the opening.

11. The window covering of claim 10, wherein the covering material further comprises a lifting cord; one end of the lifting cord is adapted to drive the slat assembly to move, and another end thereof goes into the headrail through the opening.

12. The window covering of claim 1, wherein the light-blocking bar is adjacent to the pressure-dispersion structure.

13. The window covering of claim 1, wherein the light-blocking bar and the pressure-dispersion structure are formed integrally.

14. The window covering of claim 1, wherein the part of the surface of the topmost slat contacts a side surface of the light-blocking bar.

* * * * *